US007748642B1

(12) United States Patent
King

(10) Patent No.: US 7,748,642 B1
(45) Date of Patent: Jul. 6, 2010

(54) DEVICE FOR CONSTRUCTING MODULAR WATER SPRAY CONFIGURATIONS

(76) Inventor: Patrick Dean King, 2251 Sugarridge Rd., Springhill, TN (US) 37174

( * ) Notice: Subject to any disclaimer, the term of this patent is extended or adjusted under 35 U.S.C. 154(b) by 128 days.

(21) Appl. No.: 11/827,638

(22) Filed: Jul. 12, 2007

Related U.S. Application Data

(60) Provisional application No. 60/830,652, filed on Jul. 13, 2006.

(51) Int. Cl.
*B05B 17/08* (2006.01)
*B05B 1/00* (2006.01)

(52) U.S. Cl. ..... 239/17; 239/16; 239/69; 239/600

(58) Field of Classification Search ..... 239/16–23, 239/67, 69, 211, 289, 450, 536, 548, 550, 239/551, 556, 562–564, 600; 40/406, 407; 472/92, 117, 128; 473/414; 52/220.2, 220.3, 52/220.8

See application file for complete search history.

(56) References Cited

U.S. PATENT DOCUMENTS

| | | | | |
|---|---|---|---|---|
| 4,892,250 | A | 1/1990 | Fuller et al. | |
| 6,062,983 | A * | 5/2000 | Butsook | 472/117 |
| 6,312,341 | B1 * | 11/2001 | Healy | 472/117 |
| 6,739,979 | B2 | 5/2004 | Tracy | |
| 2006/0175424 | A1 * | 8/2006 | Tatum et al. | 239/18 |

* cited by examiner

*Primary Examiner*—Darren W Gorman
(74) *Attorney, Agent, or Firm*—David D. Winters

(57) ABSTRACT

A machine for constructing modular water spray configurations with one or more flexible modules containing one or more conduits, communication between one or more modules and of one or more other modules, structure to interconnect modules, and communication between at least one module and a water source.

5 Claims, 3 Drawing Sheets

DEVICE FOR CONSTRUCTING MODULAR WATER SPRAY CONFIGURATIONS

CROSS REFERENCE TO RELATED APPLICATION

This application is entitled to the benefit of Provisional Patent Application Ser. No. 60/830,652 filed Jul. 13, 2006.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of water display and more specifically to a machine for constructing modular water spray configurations.

The beauty and aesthetic pleasure associated with streams of water impelled into the air have long been appreciated and numerous contrivances to affect the same have long been constructed. Advances in the art have been more or less continuous for millennia with modern day dynamic water displays exploiting advances in pumping capacity, increased power availability, servo mechanisms that control valves, lighting technology, and programmable computer controls among others.

Also, long appreciated has been the fact that such water displays may have active rather than vicarious recreational benefits when people are accorded access to and exposure to the streams of water. The instant disclosure is an advancement in the art of dynamic water display, active or vicarious, recreational machines.

U.S. Pat. No. 4,892,250 by Fuller et al. discloses a fountain display comprising a plurality of nozzles disposed in a pattern with the nozzles supported by a base structure such as the bottom of a pool. Underlying the base structure is a network of water supply pipes communicating through the base surface with the nozzles and a network of drain pipes communicating through the base surface with drain openings in the base surface. In addition, Fuller et al. discloses a top surface on which people may walk, such as a patio deck, having elements spaced apart, thusly comprising gaps through which water may flow in order to accumulate over the base surface where it may be drained away through the drain openings in the base surface. In addition, Fuller et al. discloses openings in the top surface through which water expelled from the nozzles may pass upwardly into the atmosphere with said top surface being supported by the aforementioned base structure. Thus, Fuller requires a permanently fixed plumbing array situated beneath a permanent base, and deck members spaced apart supported by the base. In addition, Fuller et al. teaches means to cover the openings in the top surface through which water is expelled so that people may walk over the top surface when the fountain display is not in use.

In contrast to Fuller et al., the instant art comprises portable modules, which may function individually or in combination, comprising a walking surface, and plumbing. Thus, the instant art may be easily moved, without separating disparate parts such as walking surfaces, nozzles, base surfaces, and/or plumbing. In additional contrast to Fuller et al., the instant art requires no space between elements where water may accumulate in order to be drained away or otherwise disposed of. In Further contrast to Fuller et al., the instant art teaches embodiments comprising no means by which water passing through the top surface from the interior, or from any other source independent of the instant art, may pass back through the top surface to the interior. Thus, the instant art may comprise a top surface of unitary material rather than a plurality of independent, spaced apart elements. In Further contrast Fuller et al., the instant art teaches no means to cover any openings through which water is expelled in order that the top surface may be trod upon when the water display is not in use, but rather teaches simultaneous walking upon and display of water. In yet additional contrast to the instant art, Fuller et al. teaches no modules that may communicate in order to vary the size or configurations of nozzle arrays.

U.S. Pat. No. 6,739,979 B2 by Tracy discloses a fountain comprising a support structure mounted on a ground surface, preferably a concrete slab or the bottom of a pool. The support structure comprises a water conduit from which extend a plurality of branches comprising nozzles which emit pressurized water through openings in the top surface of the support structure. The water conduit communicates with a water source by means of a main water supply pipe and a fitting. The main water supply pipe may be beneath the ground surface or above the ground surface.

In contrast to the instant art, Tracy teaches no means to connect one support structure with another so as to produce a unified and uniform surface which may be varied as to surface area and/or basic geometric configuration, nor any means for the conduits internal to one support structure to communicate with the conduits of another support structure, but rather teaches the support structures as self-contained units.

BRIEF SUMMARY OF THE INVENTION

The primary object of the invention is provide a sprayed fountain, or ballistic water display that is portable.

Yet another object of the invention is to provide a sprayed fountain, or ballistic water display that is inexpensive to manufacture and install.

Another object of the invention is to provide a sprayed fountain, or ballistic water display that is modular.

Another object of the invention is to provide a sprayed fountain, or ballistic water display that is variable.

A further object of the invention is to provide a sprayed fountain, or ballistic water display within which children or adults may play.

Yet another object of the invention is to provide a sprayed fountain, or ballistic water display that is interactive.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for constructing modular water display configurations comprising: flexible module containing conduits, communication means between conduits of one module and conduits other modules, means to interconnect modules, and communication means between at least one module and a water source.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF COMPONENTS

Figure 1:
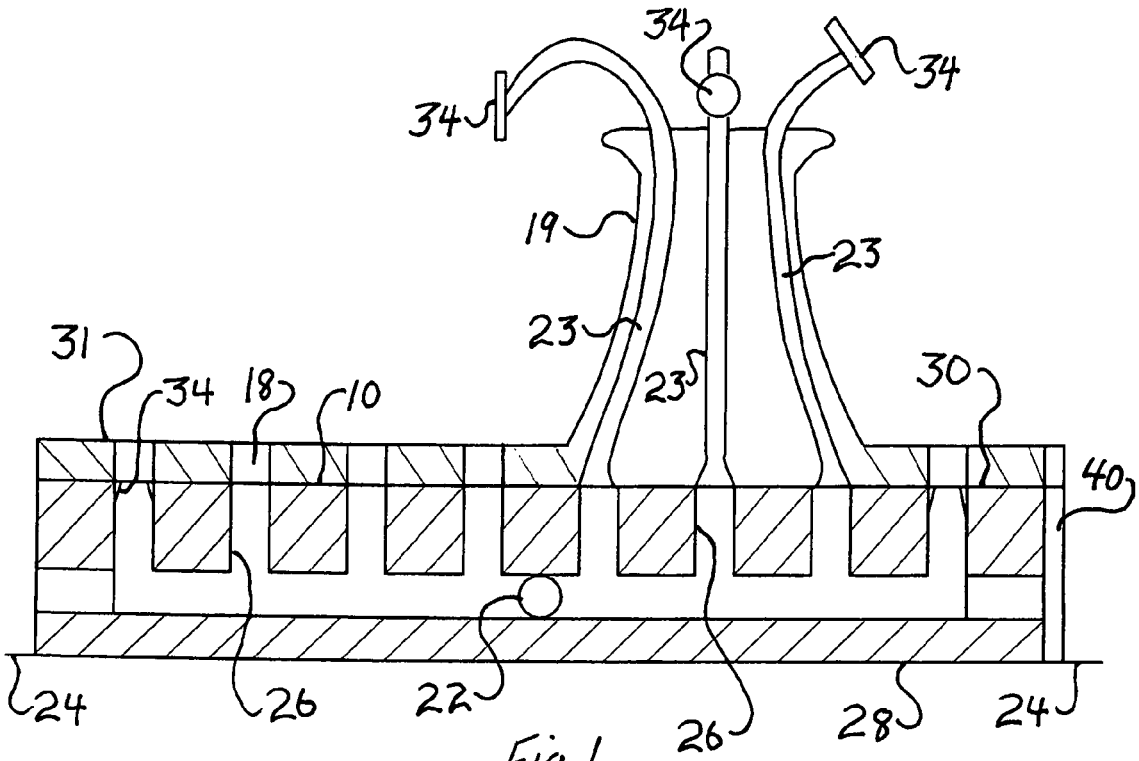
FIG. 1 is a cut-away side view showing conduits and nozzles.

10 Module body
12 Water inlet
13 Manifold box
14 Water outlet
16 Water manifold
17 Pores or openings for drainage
18 Spray opening in which one or more nozzles may be mounted
19 Artificial plant
20 Manifold outlet
22 Water conduit
23 Riser conduit
24 Ground
26 Manifold outlet branch
27 Edge ramp
28 Module body lower surface
30 Module body upper surface
31 Surface cover
32 Plug
34 Nozzle
36 Valve
37 Solenoid valve
38 Valve control means
40 Module body interconnection means
50 Integral signal connector
55 Integral signal carrier
58 Signal and power interface box
60 Integral electrical power connector
65 Integral electrical power carrier
70 Remote control unit
72 Manual or automated control input unit
74 Power and control carrier
75 Automated control device

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 2:
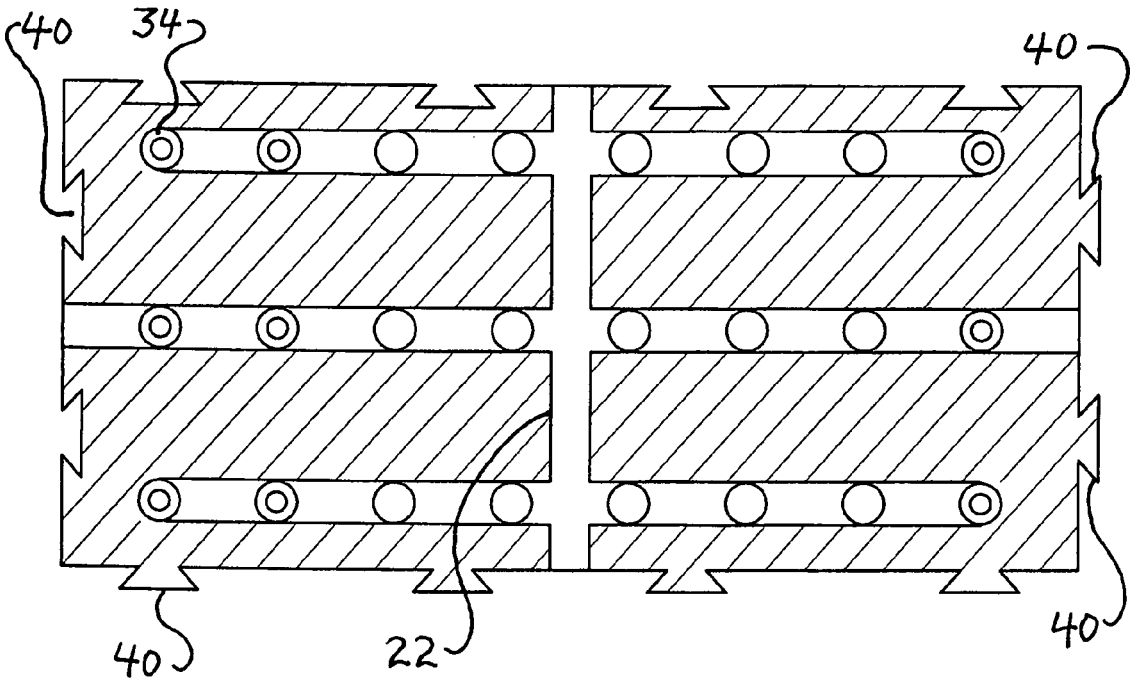
FIG. 2 is a cut-away top view showing conduits and nozzles.
Figure 4:
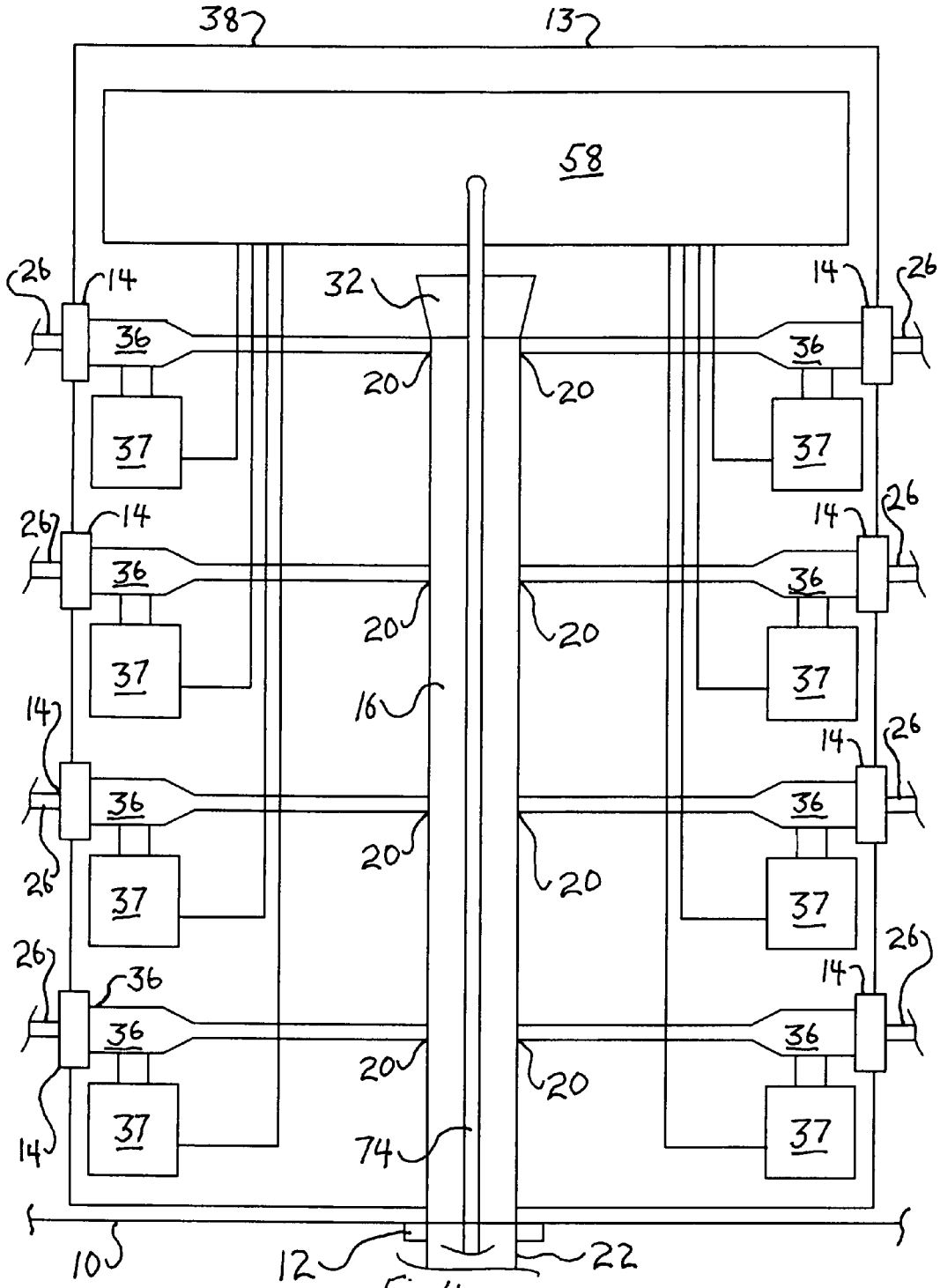
FIG. 4 is a cut-away top view showing a manifold box with power and control elements

Looking now at FIGS. 1, 2, and 4, we see a module body (10) comprising a water inlet (12), water conduit (22), water manifold (16), a plurality of water outlets (14), a plurality of water manifold outlets (20), and a plurality of water manifold outlet branches (26). In addition, we see that the module body (10) has a lower surface (28) and an upper surface (30) with the lower surface (28) resting on a ground (24), which may be any type surface either natural or contrived.

Looking further at FIG. 4, we see that the water inlet (12) allows ingress of water into the water conduit (22) which communicates with the water manifold (16). Further, we see that water manifold branches (26) communicate with the water manifold (16) and that, in FIG. 3, the water manifold branches (26) comprise jet or spray openings (18) in the module body top surface (30). Also, the spray openings (18) or manifold outlet branches (26) may comprise nozzles (34), venturi sections, or other water flow altering or enhancing means.

Now, we may understand that water may enter the module body (10) through the water inlet (12), through the water conduit (22), into the water manifold (16), through the solenoid (37) controlled valves (36), through the manifold outlet branches (26) and then out the spray openings (18). In addition, we may readily appreciate that, if water under sufficient pressure is introduced to the module body (10) through the water inlet (12), that a stream or streams of water of sufficient quantity may be ejected through the spray openings (18), equipped with nozzles (34), to a height sufficient to be easily observed as a source of visual amusement or enjoyed in an active recreational manner through contact with said stream or streams.

Further, instead of spraying water directly from ground (34) surface level, manifold outlet branches (26), with or without spray heads may be further extended upward via one or more riser conduits (23) so as to allow them to direct water downward from overhead. Such conduits (23) may be unadorned, or alternatively, they may be incorporated into novel or decorative devices such as artificial plants, trees, landscapes, play-structures, or cartoon characters and the like (19).

Looking yet again at FIGS. 1 and 2, we see that the module body (10) may comprise any of sundry means (40) to removably interconnect one module body (10) to another so that the water conduits (22) and/or manifold outlets (20) of one module body (10) may communicate with the water conduits (22) and/or manifold outlets (20) of another module body (10). Thus, a water display structure comprising module bodies (10) may be constructed wherein water may circulate through and/or between the module bodies (10) and simultaneously be ejected through the spray openings (18). One or more edge ramps as in FIG. 3 (27) may be added for additional safety and convenience.

Turning attention again to FIG. 1 and FIG. 2, we note that the module upper body surface (30) may comprise a substantially planar surface (31) on which people may walk. In addition, we may readily appreciate that said surface may comprise material having qualities to enhance the safety of people walking on it. For example, the surface (30) may be cushioned or may have non-slip or non-skid features (31). Further, the surface cover (31) may incorporate synthetic grass, plants or other decorative features (19) and may be porous, perforated, ventilated or otherwise supplied with openings (17) in such a way as to improve drainage. We may further readily appreciate that the module body (10) may comprise flexible material of suitable strength, resiliency, and/or malleability so as to comprise desirable safety qualities of itself. Alternatively, the module body (10) may comprise layers and/or sections of different materials contrived so as to affect desirable safety qualities.

Turning attention again to FIG. 4, we see that the manifold box (13) may comprise water manifolds (16), manifold outlet branches (26), manifold outlets (20), water inlets (12), valves (36), and valve control means (38). In addition, we may readily appreciate that the valve control means (38) may communicate with an automated and/or computerized device, FIG. 3 (70) (72) (75) which may cause the valves (36) to be open or closed or partially opened in any sequence so as to produce varied water displays. One preferred method for accomplishing the above includes use of electrical solenoid controlled valves (36) (37).

Figure 3:
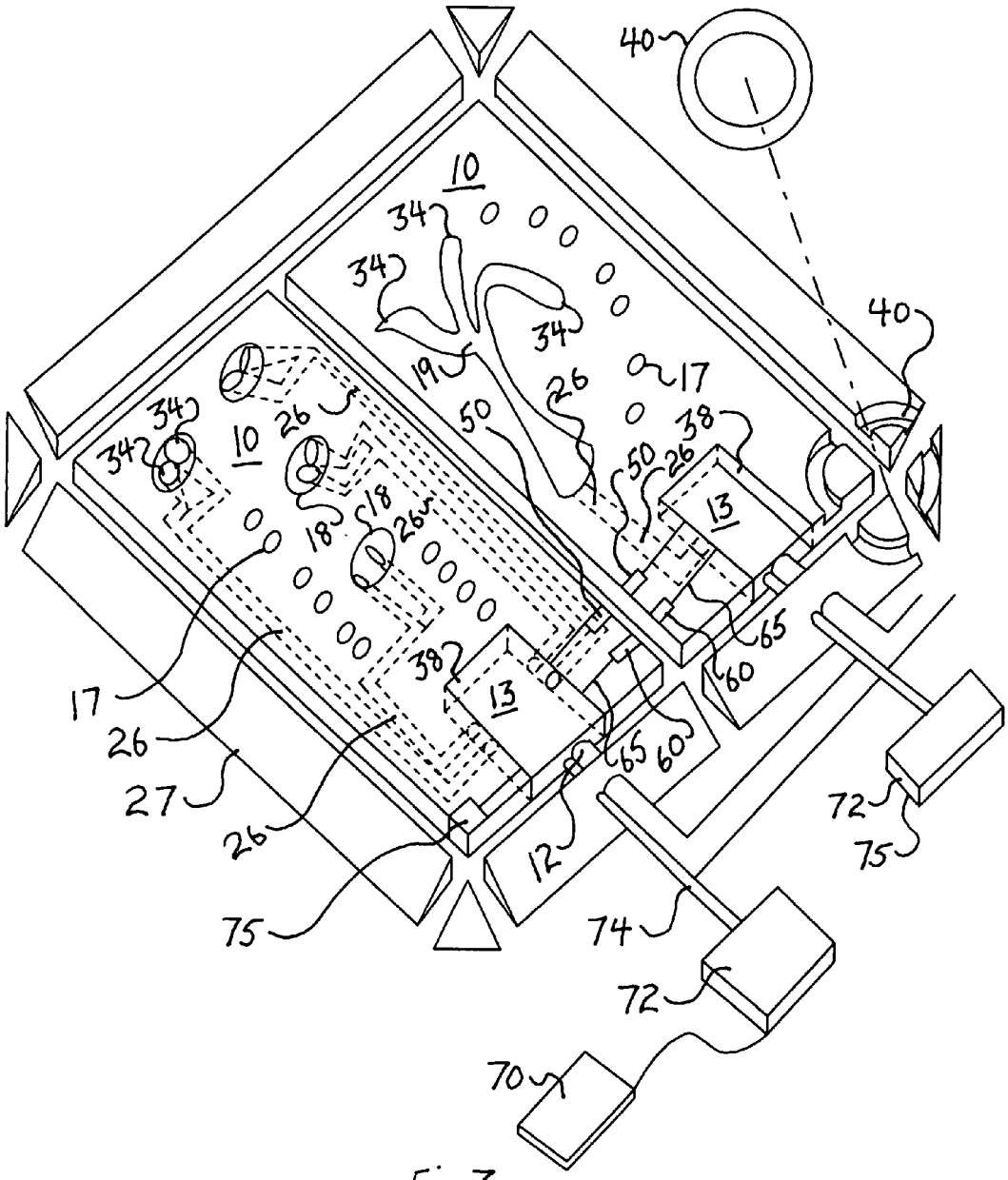
FIG. 3 is an oblique exploded view of modules, configured such that each is equipped with a manifold box.

Turning now to FIGS. 3 and 4, remote exercise of this dynamic control, may be applied in a number of ways, including, but not restricted to electrical or optical signal carriers (55) and/or power carriers (65), and connectors (50), hydraulic power provisions, or use of radio, infrared or other additional electromagnetic control signal media. Any necessary wires, optical fibers, or other carrier media (55) may be incorporated or embedded in the modules (10) as necessary, using, for example as illustrated in FIG. 4, imbedded signal connectors (50) joining integral signal carriers (55). These control components interface with a manual or automated control input unit (72), and are arranged in the illustrated case, to communicate with a remote digital computer control unit (70), via one or more control signal and/or power interface boxes (58). However, present technologies also are sufficient to allow one or more automated control devices (75) to be configured entirely within one or more module bodies (10).

Attention is now invited to FIG. 3 where we see an embodiment of the present art comprising variously configured, portable modules (10) that communicate to form a modular water spray device.

Now, we may readily appreciate that by exploiting the instant art, a modular machine comprising an array of variable configurations of at least one module body (10) or a plurality of modules (10) in communication may be constructed.

While the invention has been described in connection with a preferred embodiment, it is not intended to limit the scope of the invention to the particular form set fort, but on the contrary, it is intended to cover such alternatives, modifications, and equivalents as may be included within the spirit and scope of the invention as defined by the appended claims.

What is claimed is:

1. A modular device for constructing water displays comprising:

one or more flexible modules comprising water flow conduits, communication means between water flow conduits of one said module and water flow conduits of one or more other said modules, communication means between at least one said module and a pressurized water source, a means to removably interconnect said modules, spray or jet outlets, one or more dynamically and remotely controllable water flow valves or nozzles, wherein the water flow conduits are integrated into said modular device in such a way as to be automatically aligned and connected whenever any said modular device is connected to another said modular device, wherein control media and power media, alternatively or concurrently, are integrated into said modular device in such a way as to be automatically aligned and connected whenever any said module is connected to another said modular device, and wherein the said modules comprise pores or drainage openings such as may allow water to drain through.

2. The modular device as in claim 1, wherein the said modules are configured of such size and weight as to be quickly and easily separable and portable, thereby allowing installation to be temporary.

3. The modular device as in claim 1, wherein the water flow in and, alternatively or concurrently, expulsion from various modules may be individually, pre-programmed or dynamically controlled.

4. A device as in claim 1, wherein the modules comprise a cushioned, impact absorbent surface.

5. A modular device for constructing water displays comprising:

one or more flexible modules comprising water flow conduits;

communication means between at least one said module and a pressurized water source; and sundry means to removably interconnect said modules and communication means between water flow conduits of one said module and water flow conduits of one or more other said modules, also comprising spray or jet outlets, and also comprising one or more dynamically and remotely controllable water flow valves or nozzles, wherein the water flow conduits are integrated into said modular device in such a way as to be automatically aligned and connected whenever any said module is connected to another said modular device, and wherein control media and power media, alternatively or concurrently, are integrated into said modular device in such a way as to be automatically aligned and connected whenever any said module is connected to another said modular device.

* * * * *